US005686794A

United States Patent [19]

Streppel et al.

[11] Patent Number: 5,686,794

[45] Date of Patent: Nov. 11, 1997

[54] HALOGEN INCANDESCENT LAMP WITH FILAMENT POSITIONING ARRANGEMENT

[75] Inventors: Hans-Juergen Streppel, Wipperfuerth; Hans Liermann, Kuerten; Juergen Eder, Cologne, all of Germany

[73] Assignee: Patent-Treuhand-Gesellschaft F. Elektrische Gluehlampen mbH, Munich, Germany

[21] Appl. No.: 658,635

[22] Filed: Jun. 5, 1996

[30] Foreign Application Priority Data

Aug. 3, 1995 [DE] Germany ..... 195 28 686.3

[51] Int. Cl.[6] ..... H01K 1/18

[52] U.S. Cl. ..... 313/579; 313/273; 313/274; 313/275; 313/278; 313/279; 313/269

[58] Field of Search ..... 313/579, 578, 313/238, 271, 273, 274, 275, 278, 292, 286, 287, 288, 289, 290, 277, 279, 573, 611, 634, 269

[56] References Cited

U.S. PATENT DOCUMENTS

| | | | |
|---|---|---|---|
| 2,042,963 | 6/1936 | Rentschler et al. | 313/273 X |
| 3,840,953 | 10/1974 | Martin | 313/271 X |
| 3,983,441 | 9/1976 | Northrup | 313/273 X |
| 4,052,637 | 10/1977 | Op De Beeck | 313/273 X |
| 4,096,405 | 6/1978 | Goto | 313/273 X |
| 4,876,482 | 10/1989 | Stadler | 313/579 |
| 4,959,586 | 9/1990 | Claessens et al. | 313/273 |
| 5,006,757 | 4/1991 | Odagaki | 313/273 X |
| 5,025,188 | 6/1991 | Odagaki | 313/273 |
| 5,045,748 | 9/1991 | Ahlgren et al. | 313/113 |
| 5,146,134 | 9/1992 | Stadler et al. | 313/579 |

FOREIGN PATENT DOCUMENTS 0 143 917 6/1985 European Pat. Off. .

*Primary Examiner*—Ashok Patel

*Attorney, Agent, or Firm*—Frishauf, Holtz, Goodman, Langer & Chick, P.C.

[57] ABSTRACT

To positively locate a filament (5, 22) in position within a bulb (2) of a halogen incandescent lamp, the walls of the bulb are deformed at selected points along the length of the filament within the bulb to define at least three inwardly projecting dimples which just barely engage, or engage, the filament. Preferably, the filament is formed with a connecting portion (7) in the region of engagement, which connecting portion is either straight, coiled with a very steep pitch, or, if the filament is double-coiled, only single-coiled. The connecting portion (7) may be electrically short-circuited by a core pin (39). If the bulb is single-ended (FIG. 3), a return lead (29) along the wall of the bulb, can be pinched between adjacent walls (45) of adjacent dimples. The dimples, looked at from the outside of the lamp, are essentially funnel-shaped and, in cross section, may be circular, or if space between adjacent dimples is insufficient, may be elliptical.

20 Claims, 6 Drawing Sheets

HALOGEN INCANDESCENT LAMP WITH FILAMENT POSITIONING ARRANGEMENT

Reference to related patents, the disclosures of which are hereby incorporated by reference:

U.S. Pat. No. 5,146,134, Stadler et al., assigned to the assignee of the present application;

U.S. Pat. No. 5,045,748, Ahlgren et al.;

U.S. Pat. No. 3,983,441, Northrup.

Reference to related patent disclosure:

European 0 143 917 A2, Blumberg et al.

FIELD OF THE INVENTION

The present invention relates to a halogen incandescent lamp, and more particularly to a halogen incandescent lamp having a tubular bulb, which is formed with an arrangement to positively position the filament within the bulb. The arrangement is particularly suitable for use with tubular bulbs which may be operated in horizontal position, or with lamps where the filament position within the lamp is of significance. Preferably, the power rating of the lamp is high, 200 W and more.

BACKGROUND

Halogen incandescent lamps in which the filament is supported by an arrangement made from the glass of the bulb itself have previously been proposed; see, for example, U.S. Pat. No. 5,146,134, assigned to the assignee of the present application. The halogen incandescent lamps may be single-ended or double-ended. The wall of the filament is supported by support ribs placed within the lamp and formed from the lamp bulb material itself. The ribs, formed by inwardly extending protrusions, extend between two approximately radially opposite regions, or points, of the wall of the bulb. It has been found that precise adjustment of the position of the filament is difficult to obtain, particularly if, in manufacture, the rib is shifted from the exact position it is supposed to have within the lamp. Precise positioning is particularly important in lamps which are coated.

Double-ended halogen incandescent lamps, that is, lamps which are terminated in two pinch seals, are described in European published patent application 143 917 A, Blumberg et al. An axial filament is maintained in position by a pair of inwardly extending dimples located at radially opposite sides of the wall of the bulb and securing wire holders which, in turn, are intended to hold the filament in position.

U.S. Pat. No. 3,983,441, Northrup, and U.S. Pat. No. 5,045,748, Ahlgren et al. describe double-ended pinch-sealed halogen incandescent lamps in which individual filament portions are separated from each other by radial-symmetrical inwardly extending reduced sections, which surround the incandescent element or, with space therefrom, respectively, to separate the respective portions of the filament.

THE INVENTION

It is an object to provide a halogen incandescent lamp having a filament which is precisely centered within the lamp bulb.

Briefly, a positioning arrangement for the filament is provided, formed of material of the bulb itself, which includes at least one system formed by at least three inwardly extending protrusions or dimples. These protrusions or dimples are made by deforming the tubular bulb, so that the dimples project inwardly from the bulb circumference towards the bulb axis and, each, are formed essentially in funnel shape. The dimples of any one system are located in a plane extending transversely to the bulb axis, and are circumferentially, essentially uniformly, spaced from each other.

The present invention can be used for single-ended or double-ended halogen incandescent lamps; it is particularly suitable for double-ended halogen incandescent lamps, since the filament therein is relatively long and may require support at more than one location within its length. Lamps of this type, additionally, are frequently coated with materials forming interference filters, in which exact centering of an axial filament is important. The filaments are, typically, single-coiled or may be of the coiled-coil type, that is, double-coiled. Such lamps, e.g. with infrared reflective coating (IRC) or the like, require, for optimum operation, exact axial centering of the filament within the lamp. Lamps of this type are used, generally, for direct connection to a network voltage, for example of between 80–250 V, 50, 60 Hz.

The filament of the halogen incandescent lamp can be singly coiled or doubly coiled. Generally, it has portions which emit light and at least one connecting portion. The positioning arrangement engages the connecting portion. In accordance with a preferred feature of the invention, the connecting portion may be a coiled section of the filament in which the pitch of the coiling, however, is increased, preferably substantially, with respect to the pitch of the coiling which emits light. If a double-coiled filament is used, the flattened, or extended spiral, that is the high-pitch, is applied to the secondary coiling. Extending the pitch of the coil, or of the secondary coiling, provides for lowering of the temperature in the region in which the dimples project towards the filament. Alternatively, the connecting portion can be short-circuited by a core pin; the filament may also be separated in coiled sections and uncoiled, or straight sections, in which the uncoiled or straight sections from the connecting portions, and are located in the region of the inwardly extending dimples.

Usually each, or the single system of inwardly extending protrusions, in the form of dimples, is formed by three or four essentially funnel-shaped dimples, all located in one single plane. For some lamps, four or five dimples per system may be used.

Single-ended halogen incandescent lamps usually require only a single system of three, four, or more inwardly extending protrusions or dimples. In single-ended lamps, a support wire is provided for the filament extending from a distal end to the proximate end, with respect to the base of the lamp. The support or return wire is preferably located between respective dimples of the single system, and it may even be pinched or clamped between the walls of two dimples. Double-ended lamps usually have at least two systems, and frequently three, or more, depending on the length of the bulb.

The segment of the bulb between the system may be cylindrical or, in some cases, and usually when using coatings on the bulb, may be bulged outwardly, for example to be barrel shaped, or ellipsoid shaped.

The bulb can be exhausted, and filled with a halogen containing fill through an exhaust stub which is then tipped off; the exhaust stub can be located in the plane of a system between two dimples, or it may be located outside of the plane of a system. The invention, also, is useful and particularly applicable for lamps which do not have a separate pumping stub.

The inwardly extending protrusions, or dimples, may be formed, basically, in two general arrangements. In a first embodiment, the dimples only surround the incandescent filament loosely without, however, touching it. The space between any dimple and the filament is very small, which prevents excessive excursion of the filament from an axial position thereof, but does not hold it in fixed position. In another embodiment, the dimples touch the filament and positively fix it, or, rather, the connection portion thereof, directly, similarly to the known rib technology, described in the referenced Stadler et al U.S. Pat. No. 5,146,134.

"Touching" herein means that the dimples, in one embodiment, just touch the filament at the periphery, whereas, in another embodiment, the dimples themselves touch each other at the inner ends thereof, to completely surround the filament, or, even completely pinch or clamp the filament between the respective ends or apices of the dimples.

The present invention, by eliminating holding rings, can be made much more cheaply than heretofore, and the accuracy of positioning of the luminescent element, typically the filament, is better than when using the rib technology.

The system of dimples is made by circumferentially heating the bulb with three or, respectively, four or more gas burners after the incandescent filament has been introduced in the bulb, and the end or ends of the bulb have been pinch-sealed. The heated bulb is pressed inwardly with the corresponding number of punches, shaped to form the dimple in the finally desired shape. The dimples are so shaped that the luminous element, typically the incandescent filament, is restricted in its movability, or even fixed in position, in axial as well as in radial direction with respect to the axis of the bulb. Those portions of the luminous element, or the entire luminous element as such, which are not axially aligned before the dimples are formed, are automatically placed in their appropriately aligned position as the dimples are being formed. Luminous elements, typically filaments, which may have started to oscillate during the manufacture of the lamp and which therefore could be subjected to the danger of being incorrectly fixed in position, are thereby, automatically aligned and placed in the appropriate position within the bulb.

The above process can be varied, and it is a substantial advantage of the present invention that, if the dimples do not touch or engage the luminous element, but are slightly spaced therefrom, the luminous element can be introduced into the bulb after the dimples have been made. This permits pre-forming and coating of segments of the bulb without interference, for example from the heating system to make the dimples.

DRAWINGS

FIG. 1*a* is a highly schematic side view of a double-ended halogen incandescent lamp, in which conventional parts are shown only schematically;

FIG. 1*b* is an illustration of the lamp of FIG. 1*a*, rotated 90° with respect to FIG. 1*a;*

FIG. 2*a* is an illustration similar to FIG. 1*a* of a lamp having four dimples forming each dimple system and illustrating another embodiment of the bulb as well;

FIG. 2*b* is a side view of a lamp similar to that shown in FIG. 1*a*, but having six dimples in each dimple system;

FIG. 3 is a front view of a single-ended lamp having one dimple system;

FIG. 4*a* is a cross-sectional view of a lamp bulb having a dimple system constituted by three dimples, taken in a plane transverse to the axis of the lamp and through the dimple system;

FIG. 4*b* is a cross-sectional view similar to FIG. 4*a*, but illustrating a dimple system having four dimples;

FIG. 4*c* is a longitudinal view to a greatly enlarged scale of a lamp bulb in the region of a dimple system having four dimples, as shown in FIG. 4*b*, and schematically showing the coiling of a filament wire within the dimple system;

FIG. 5*a* is a cross-sectional view similar to FIG. 4*a* and illustrating a different shape of dimples; and FIG. 5*b* is a longitudinal fragmentary sectional view, similar to FIG. 4*c*, and illustrating the dimple system shown in FIG. 5*a*.

DETAILED DESCRIPTION

Figure 1A:
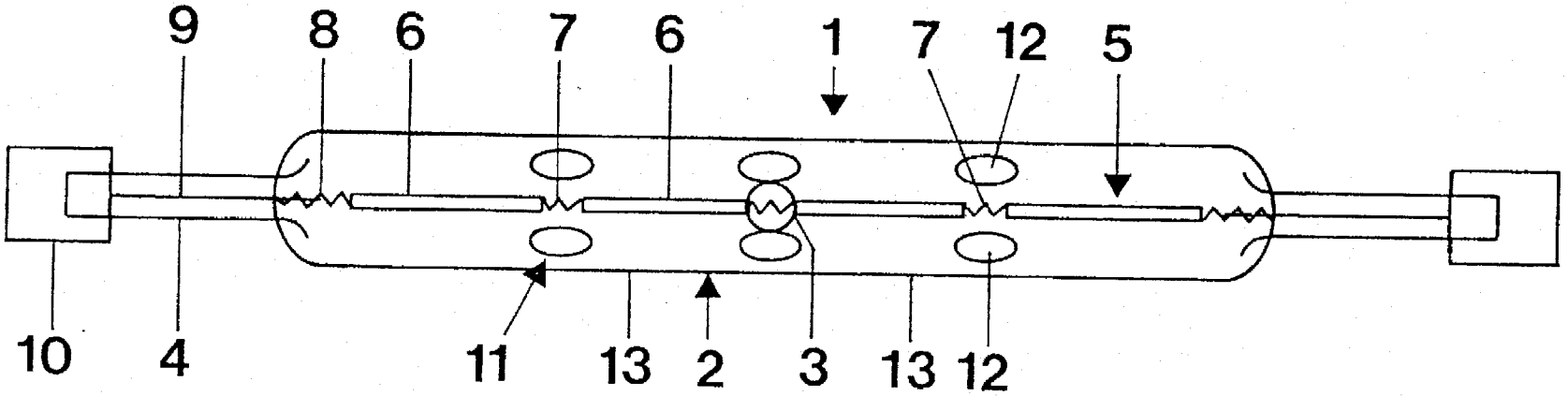
Figure 1B:
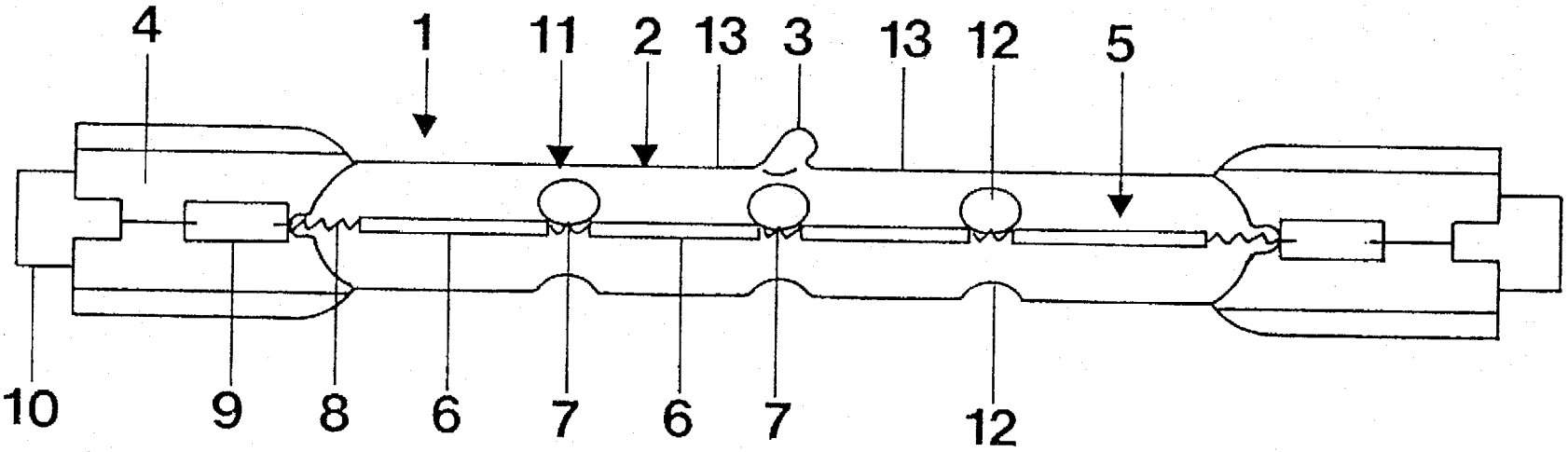

FIGS. 1*a* and 1*b* both illustrate a double-ended pinch-sealed, double-based halogen incandescent lamp 1, suitable for general service use, and, in the example selected, having a power rating of 500 W, suitable for example for direct connection to a 230 V power network. The lamp 1 has a cylindrical bulb 2 of quartz glass with an inner diameter of 7 mm and an overall length of 105 mm. A pumping tip 3 is located centrally on the lamp bulb. Both ends of the lamp bulb are closed and sealed by a pinch seal 4. The bulb 2 is filled with an inert gas, for example argon, which has a halide additive, as well known.

The luminous element 5 within the lamp, typically an incandescent filament, is divided into light emitting portions 6 and connecting portions 7. The element 5 is a single-coiled filament. The pitch of the coiling in the region of the connecting portions 7 is higher—preferably substantially higher than that of the luminous portions 6. The luminous element 5 is connected over two singly coiled current supply portions 8, the pitch of which is higher, and preferably substantially higher than that of the luminous portions 6, which in turn are connected to melt-sealed foils 9, embedded in the pinch seals 4, which in turn are connected to terminals in ceramic bases 10, as well known and in accordance with well-known structures of lamps of this type.

In accordance with a feature of the present invention, three systems 11 of inwardly extending dimples 12 are located over the length of the light emitting portion of the bulb, preferably at least approximately uniformly spaced from each other. They retain the luminous element 5 in essentially point-form contact in position so that the adjacent light emitting portions 6 of the luminous element 5, that is, the portions between the dimple systems 11 as well as portions adjacent the end portions 8, do not hang through and are located in well centered position within four cylindrical bulb segments 13. The bulb segments 13 are separated from each other by the respective dimple systems 11. Surprisingly, the halogen cycle of the lamp is not interfered with by the systems 11, and the optical characteristics of the lamp remain homogeneous.

Each system 11 is formed by three dimples 12 located in a plane extending transversely to the axis of the lamp. The dimples 12 are essentially funnel-shaped and spaced from each other by about 120°. Starting from the wall of the bulb, they are directed inwardly towards the luminous elements 5. The funnel-shaped dimples are, in cross section, circular. Due to perspective of the illustration, the dimples are shown distorted, that is, elliptical; they are, however, actually circular in cross section.

Figure 2A:
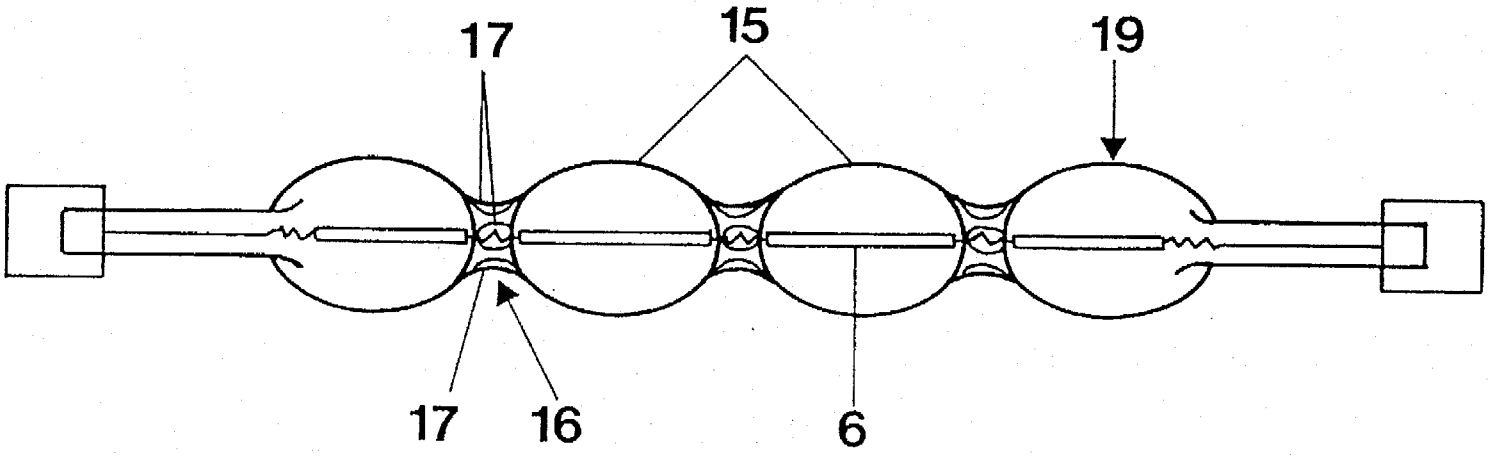

FIG. 2*a* illustrates a further embodiment, in that the bulb segments 15 between the dimple systems 16 are ellipsoid or barrel-shaped and coated at their outside with an interference filter coating 19. The light emitting element 6 is retained in position by three dimple systems 16, in which each system is formed by four dimples 17, relatively spaced from each other by 90°. Since four dimples provide smaller spacing between adjacent dimples, the dimples 17 are shaped somewhat elliptically in cross section. The longer axis of the ellipse is parallel to the longitudinal axis of the lamp. The lamp, as well known, does not have any lateral pumping stubs, which improves its optical characteristics.

Figure 2B:
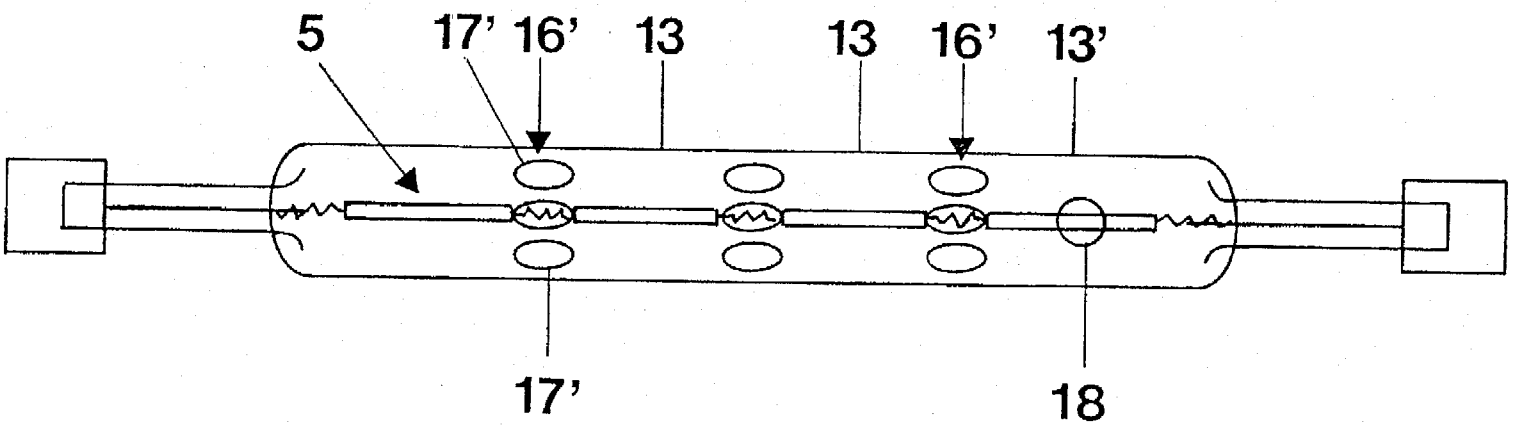

FIG. 2*b* also illustrates another double-ended pinch-sealed lamp which, in general, is similar to the embodiment shown in FIG. 1*a* and 1*b*, and has cylindrical bulb segments 13. The light emitting element 5 is held in position by three dimple systems 16'. Each dimple system 16' is formed by six dimples 17', spaced from each other by 60°. Very little space is available between adjacent dimples, and thus the funnel of the dimples 17' is shaped to be highly elliptical. A pumping stub 18 is located centrally in the last bulb segment 13'.

Figure 3:
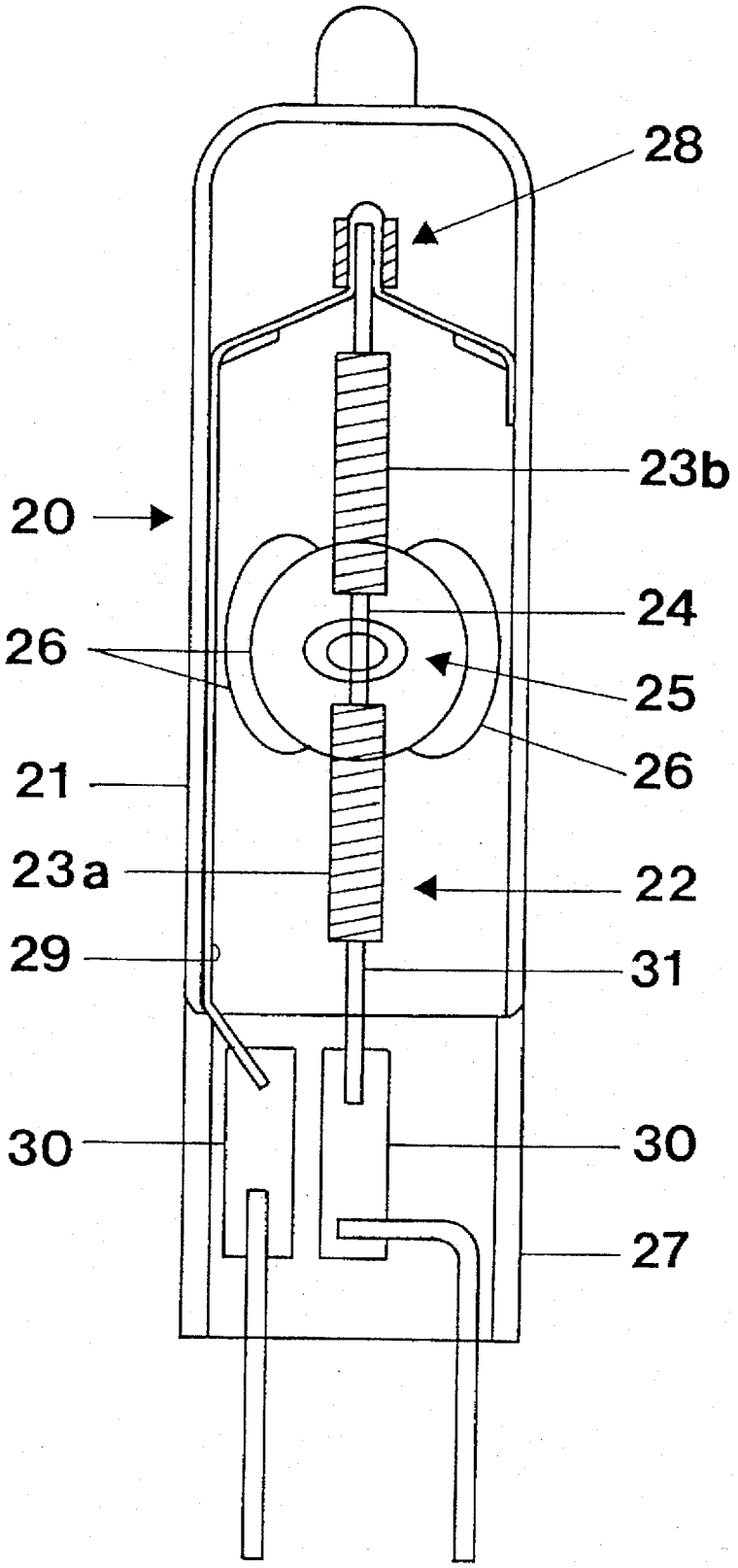

The invention is not limited to a double-ended lamp in which hang-through of long filaments is a problem. FIG. 3 illustrates a single-ended pinch-sealed lamp 20 having an essentially cylindrical bulb 21 and an axially extending light emitting element 22, typically an incandescent filament, connected by two current supply leads 29, 31, with connecting foils 30, embedded in the pinch seal, as well known. The light emitting element 22 has two single-coiled incandescent portions 23*a* and 23*b*, integrally connected by an intermediate connecting portion 24, which is straight and not coiled. At the level of the connecting portion 24, and essentially centrally within the light emitting region of the bulb, a single retention system 25 is located formed by three dimples 26, extending transversely to the axis of the lamp. The end 28 of the filament remote from the base and the pinch seal 27 is connected to one of the foils 30 in the pinch seal 27 by the lead 29, forming a return current supply lead. The return lead 29 is placed exactly between two adjacent dimples 26.

Figure 4A:
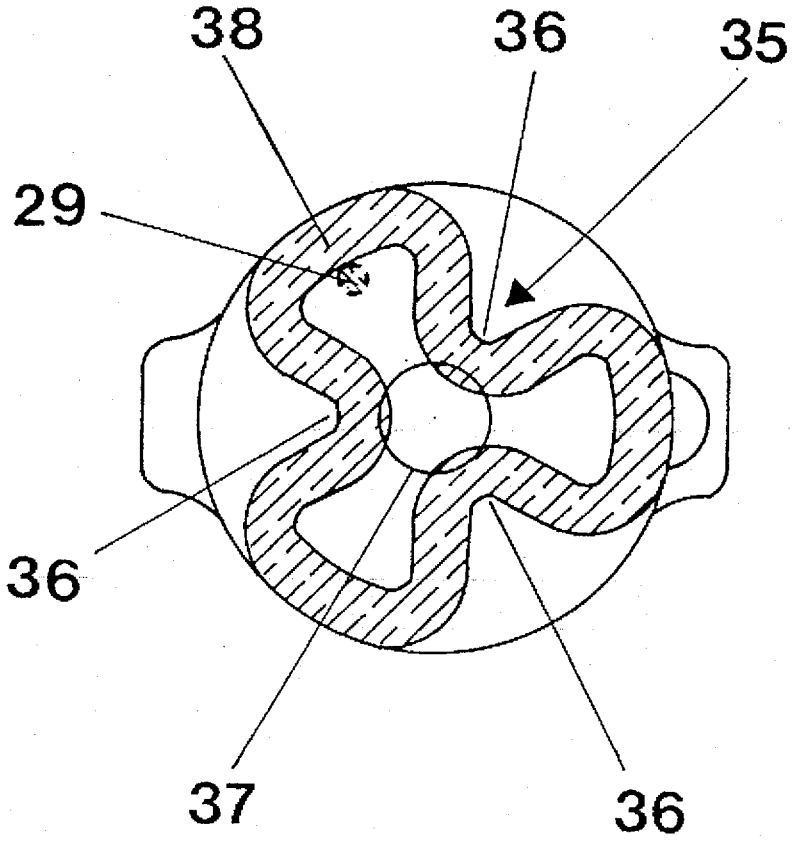

FIG. 4, collectively, shows details of the arrangement of the dimples, in which FIG. 4*a* illustrates a first embodiment, showing the dimples, for example as-used in FIGS. 1*a*, 1*b*, 2*a*, 2*b*, and 3. The cross section, see FIG. 4*a*, at the level of the dimple system 35, clearly shows that the system is formed by three dimples 36 which extend up to the incandescent element 37 and locate it in position. If this system is used in the single-ended lamp shown in FIG. 3, requiring a return lead, the return lead 29 is placed between dimples, and shown in FIG. 4*a* in dotted position, since, for a double-ended lamp, it is not used. It is located between two dimples 36, extending parallel to the axis of the lamp adjacent the wall 38 thereof.

Figure 4B:
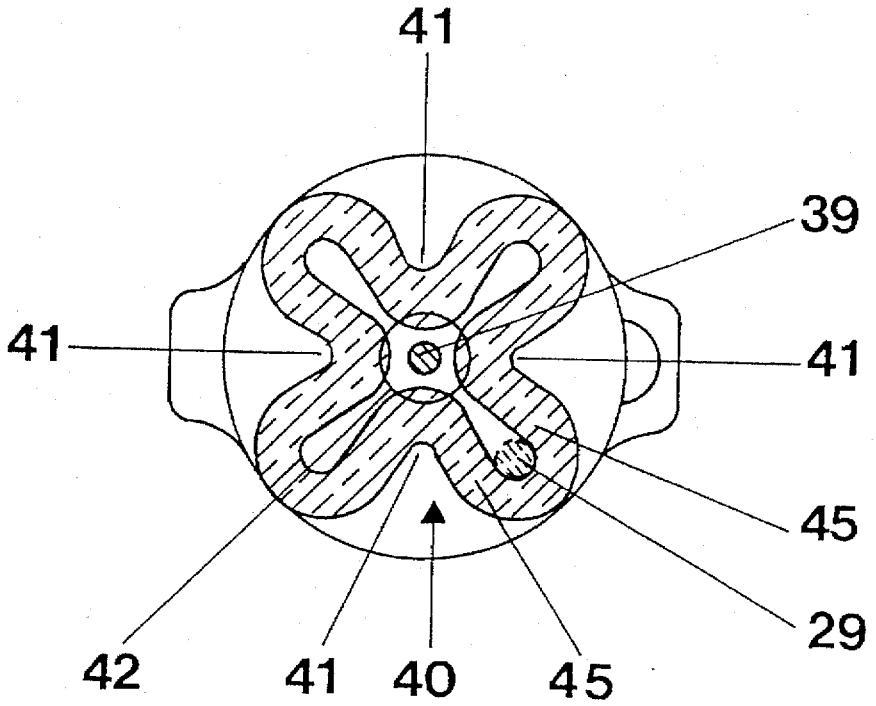
Figure 4C:
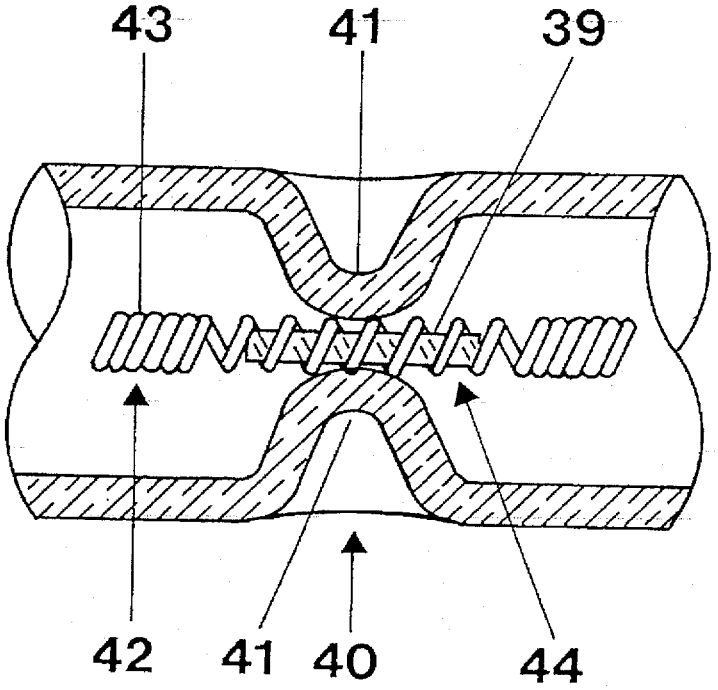

FIGS. 4*b* and 4*c* show, respectively, a cross section and a longitudinal section of a lamp bulb having a dimple system 40 formed by four dimples 41 extending up to the incandescent element 42. The incandescent element 42 is a single-coiled filament, in which the light emitting portion 43 is tightly coiled, whereas the connecting portion 44 has a substantially higher pitch. The central portion is short-circuited by a core pin 39, and thus is not incandescent. The incandescent element 42 is axially as well as radially fixed in position within the lamp bulb. FIG. 4*b*, also, shows the return lead 29, if this arrangement of dimples is used in a single-ended lamp. The return lead 29 is pinched between the walls 45 of adjacent dimples 41. FIGS. 4*a* and 4*b* also illustrate that, where the filament is tightly coiled, its outer diameter is slightly greater than in the region of the dimples 36, 41, respectively.

Figure 5A:
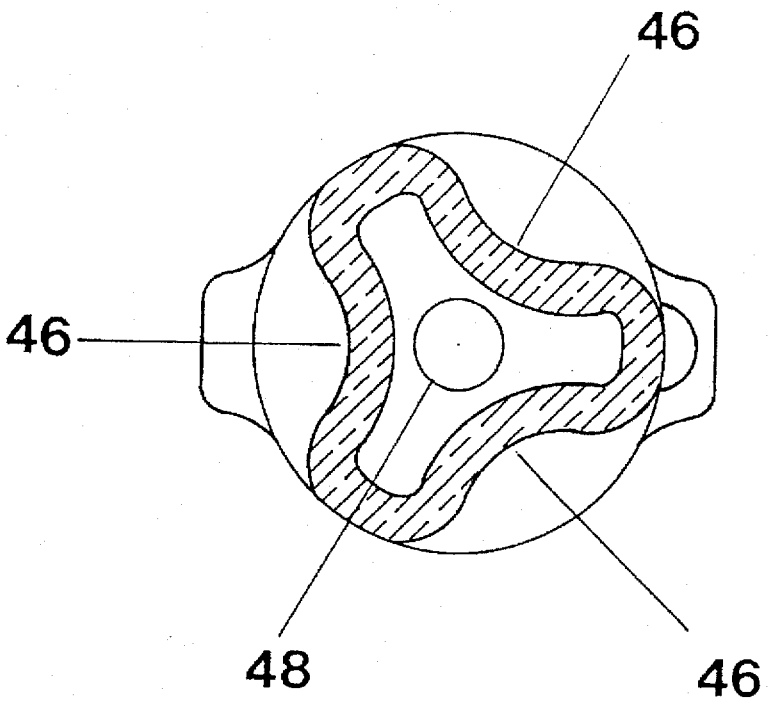
Figure 5B:
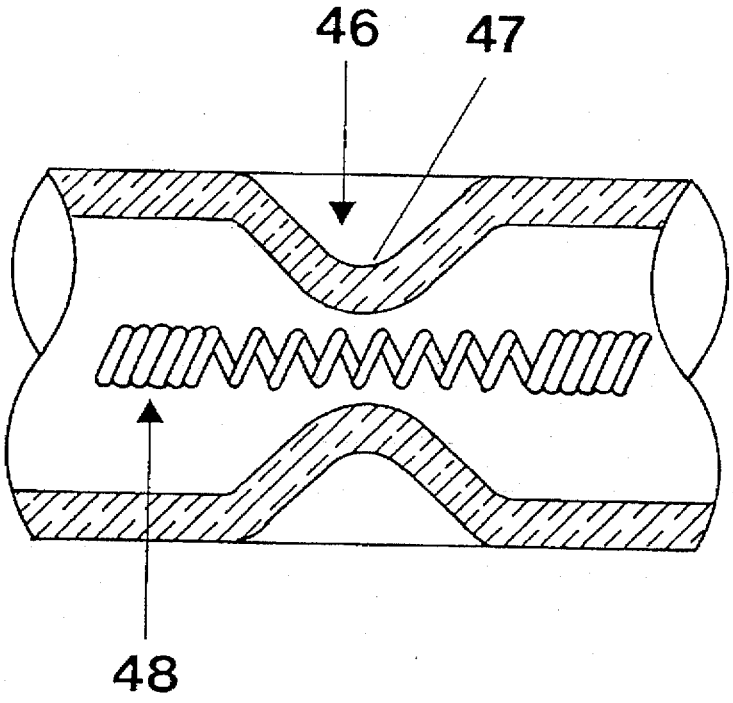

FIGS. 5*a* and 5*b* are generally similar to FIGS. 4*b* and 4*c*, illustrating however another embodiment of the invention, in which the shape of the dimples is different from that previously described. The funnels of the dimples 46 have a greater cross section than the dimples shown in FIG. 4 at the outside, that is, in the vicinity of the wall of the bulb. The depression formed by the dimple is more shallow. The bottom 47 of the dimple does not extend all the way to the incandescent filament 48. It terminates shortly before engaging the filament. The dimensions of the dimples 46 and of the filament 48 are so matched to each other that, in spite of the small gap between the inner apex of the respective dimple 46 and the filament, the filament is left with only little freedom of movement. The filament is, however, substantially restricted in its freedom to deviate from its desired axial position by the dimples, but not fixed in position. Using at least three dimples for each system is sufficient to obtain such restriction of deviation or movement. If only two dimples were used, the movement would be unrestricted with respect to a dimension transverse to the dimples.

The width of the gap between the filament and the apices of the dimples is not critical; suitable and preferred dimensions are between about 1 to 10 times the diameter of the filament wire. The space between the inner projection of the respective dimple and the filament will depend, for example, on the type, power rating of the lamp, and whether the filament is single-coiled or double-coiled.

The invention is not limited to the examples shown; it can be applied to many different types of lamps, for example lamps operated at higher than customary network voltages, as well as voltages lower than network voltages, and also low-voltage lamps.

The light emitting element can be single-coiled as well as double-coiled. If double-coiled filaments are used, it is possible to so arrange the lamp that only the light emitting portions are double-coiled, whereas the connecting portions are only single-coiled. The technology described, using coiling of different pitch, and/or use of a core pin, can be applied equally to double-coiled filaments.

A typical wall thickness of the bulb of the lamp, for example, as described in connection with FIGS. 1*a*, 1*b*, is as standard in the industry, for example the same as for lamps of the prior art.

Various changes and modifications may be made, and any features described herein may be used with any of the others, within the scope of the inventive concept.

What is claimed:

1. A halogen incandescent lamp, particularly for connection to a network voltage supply, having a hermetically sealed bulb (2) of transparent material defining a bulb axis;

a fill including an inert gas and a halide additive within said bulb;

a filament (5, 22) having two ends, axially located within said bulb;

current supply means (8, 29, 31) connected to the end of the filament; and an arrangement for positioning said filament and formed of said material of said bulb, said arrangement comprising, in accordance with the invention, at least one system (11, 16, 25, 35) of positioning dimples, each said system including at least three dimples (12, 17, 26, 36) which extend inwardly from the circumference of the bulb toward the bulb axis, and which are essentially funnel-shaped; and wherein all said dimples (12, 17, 26, 36) of said at least one system are located in a plane extending transversely to said bulb axis, and are circumferentially essentially uniformly spaced from each other about said bulb axis.

2. The lamp of claim 1, wherein the lamp is a double-ended lamp and the bulb (2, 21) is terminated at two/ends by pinch seals.

3. The lamp of claim 1, wherein the filament (5) is positioned at two spaced points by a respective one of said at least one systems (11).

4. The lamp of claim 1, wherein said filament (5) comprises at least one of: a single-coiled filament; a double-coiled or coiled-coil filament.

5. The lamp of claim 1, wherein the filament (5, 22) includes at least, two light emitting portions, (6) and a, connecting portion (7) intermediate said light emitting portions, said at least one system (11, 16, 25, 35) being located in axial alignment with said connecting portion (7).

6. The lamp of claim 5, wherein the filament (5, 22) is a coiled filament, and the connecting portion (7, 44) has a steeper or higher pitch than the light emitting portions (6, 43).

7. The lamp of claim 5, wherein the filament (5, 22) is a coiled filament; and a core pin (39) is provided, located in the connecting portion (44) for short-circuiting the connecting portion.

8. The lamp of claim 5, wherein the filament is a single-coiled filament, and said connecting portion (44) is a straight, uncoiled portion.

9. The lamp of claim 5, wherein said filament is a double-coiled filament, and said connecting portion is single-coiled.

10. The lamp of claim 5, wherein the apices of the dimples (41) projecting towards the filament (42) engage the filament and positively fix the filament in position at the connecting portion (44).

11. The lamp of claim 1, wherein said dimples (46) of any one system (11, 16, 25, 35) loosely surround the filament (5, 22, 48), the apices of the dimples projecting towards the filament being slightly spaced from the filament optionally by a distance of about 1 to 10 times the diameter of the filament.

12. The lamp of claim 1, wherein said lamp (20) is a single-ended lamp, and the lamp bulb is terminated at one end by a pinch seal.

13. The lamp of claim 12, wherein said lamp comprises only one (25) said system.

14. The lamp of claim 12, wherein said lamp includes a return lead (29) connected to an end of said filament (22) remote from said pinch seal to the pinch seal;

and wherein said return lead (29) is located adjacent the wall of the bulb and positioned between two dimples (36) of said one system (25) and, optionally, is clamped or pinched between the walls (45) of said two dimples.

15. The lamp of claim 1, wherein the lamp is a double-ended lamp and the bulb (2, 21) is terminated two by pinch seals;

and wherein at least two of said systems (11) are provided.

16. The lamp of claim 1, wherein said bulb defines bulb segments (13, 15) which are located between the systems; and wherein said bulb segments between the systems are at least one of: cylindrical; ellipsoid or barrel-shaped and bulged outwardly, and wherein, optionally, said bulb segments between the systems are coated with a coating (19).

17. The lamp of claim 1, wherein the funnel-shaped dimples (12, 26, 36), in cross section, are essentially circular.

18. The lamp of claim 1, wherein the funnel-shaped dimples (17), in cross section, are essentially elliptical.

19. The lamp of claim 1, wherein each system comprises three dimples.

20. The lamp of claim 1, wherein each system comprises four or six dimples.

* * * * *